United States Patent [19]

Maes et al.

[11] Patent Number: 4,794,958

[45] Date of Patent: Jan. 3, 1989

[54] AUXILIARY NOZZLE FOR AIR JET LOOM

[75] Inventors: Dirk Maes, Zonnebeke; Patrick Nuytten, Ieper; Marnick Cardoen, Zonnebeke; Philippe Van Bogaert, Schaarbeek; Jozef Verhulst, Zillebeke; Gilbert Dejonghe, Beselare; Jozef Trioen, Dikkebus, all of Belgium

[73] Assignee: Picanol N.V., Belgium

[21] Appl. No.: 121,861

[22] Filed: Nov. 17, 1987

[30] Foreign Application Priority Data

Nov. 21, 1986 [DE] Fed. Rep. of Germany ..... 3639867
Dec. 17, 1986 [DE] Fed. Rep. of Germany ..... 3643058

[51] Int. Cl.[4] ..... D03D 47/28
[52] U.S. Cl. ..... 139/435
[58] Field of Search ..... 139/435; 226/97

[56] References Cited

U.S. PATENT DOCUMENTS

| | | | |
|---|---|---|---|
| 4,344,462 | 8/1982 | Hasegawa et al. | 139/435 |
| 4,372,348 | 2/1983 | Gunnemann | 139/435 |
| 4,585,038 | 4/1986 | Knisely | 139/435 |

FOREIGN PATENT DOCUMENTS

| | | | |
|---|---|---|---|
| 53216 | 11/1980 | European Pat. Off. | 139/435 |
| 2119238 | 11/1971 | Fed. Rep. of Germany . | |
| 2522335 | 12/1975 | Fed. Rep. of Germany . | |
| 75646 | 4/1985 | Japan | 139/435 |
| 173143 | 9/1985 | Japan | 139/435 |

*Primary Examiner*—Henry S. Jaudon
*Attorney, Agent, or Firm*—Bacon & Thomas

[57] ABSTRACT

An auxiliary nozzle for an air jet loom is configured as straight tubule closed and tapered blade-like at its free end and moveable with the loom batten into and out of the formed sheds. At least one blow aperture near the closed end of the tubule is provided in the shape of a slot extending essentially transverse to the tubule axis. The slot has a width not exceeding 0.8 mm and lateral walls configured so that the least or critical cross-section is bounded at least on one side by an edge having a thickness not exceeding 0.2 mm. If one edge is provided, it is located on the lower side of the slot toward the air supply and away from the closed end of the tubule. Various aperture configurations are disclosed.

17 Claims, 3 Drawing Sheets

Fig.9
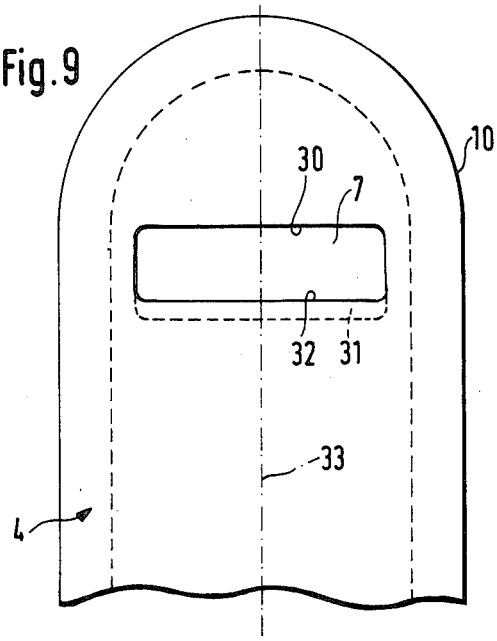
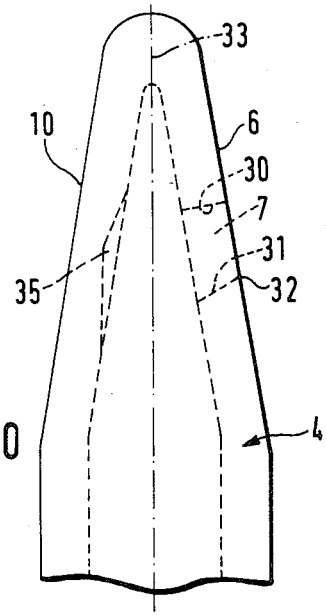
Fig.10

AUXILIARY NOZZLE FOR AIR JET LOOM

BACKGROUND OF THE INVENTION

1. Field of the Invention

This invention concerns an air-jet loom including a main jet nozzle for inserting the weft yarns into the loom shed and auxiliary, weftwise spaced nozzles mounted serially in the direction of motion of the weft yarns, the latter mounted on a batten and consisting of straight tubules closed at their free ends and tapered to a sharp tip near their ends. The auxiliary nozzles each furthermore are provided with an essentially plane lateral surface including at least one blow aperture directed upwardly towards an essentially U-shaped weft guide channel formed by reed blades of the loom and angled towards the direction of motion of the weft yarns.

2. Description of Related Information

A problem exists in air jet looms of the type mentioned above in regard to filling the reed-formed guide channel as uniformly as possible with the weft conveying air to assure reliable and problem-free weft conveyance. On the other hand, the air consumption for such conveyance must be minimized to keep the energy consumption of the jet loom as low as possible. Moreover, it has been found in practice that different weaving materials require strongly different air flows. Illustratively, it is easier to move a course cotton yarn with a moderate air flow than a filament yarn which demands a more intense air flow. Accordingly, practice usually demands that the auxiliary nozzle be operated at varying supply pressures.

It is known from German Auslegeschrift No. 21 19 238 to provide the auxiliary nozzles with blow apertures in the form of circular holes. It was found, however, that the direction of blowing for larger diameters of such nozzles varied with the applied auxiliary air pressure and shifted as this pressure varies. Therefore, such nozzles are appropriate only when the same material is being woven and when no change in air pressure is required.

It is further known from the German Patent No. 25 22 335 to provide a number of individual holes in an auxiliary nozzle arranged like a sieve in lieu of a single large aperture acting as the blow hole in the nozzles. These individual holes are arranged on a circular surface and are meant to divide the air into a number of separate jet streams which, a very short distance beyond the blow aperture, combine again into a single steam. It was found possible upon properly selecting the dimensions of the individual holes and upon suitably arraying them to improve the stability of the blow system, that essentially the same blow direction is retained even when the auxiliary air supply pressure varies. However, these individual holes cause flow losses which are cumulative and result in a higher total loss than a single large hole per auxiliary nozle. Moreover, it is a fairly complex and expensive procedure to produce the plurality of individual holes, and the small holes clog more easily, requiring laborious cleaning, for example by ultrasonic systems.

It is further known to provide auxiliary nozzles each having a blow aperture in the shape of a five-arm star. With this design, the blown-out air jet stream is divided at the exit from the blow aperture thereby presenting a substantially enlarged peripheral area in contact with the surrounding air. Accordingly, the blown out jet entrains comparatively much surrounding air as "secondary air", and a relatively small blown out air flow can generate a comparatively large flow of weft conveyance air. Compared to the design of the singular circular hole acting as the blow aperture, the stability of the star blow hole is somewhat improved at varying conveyance pressures. In this design, however, the directional stability does not assume a significant role, at least to the extent that the entrainment of secondary airproduces a relatively large air flow which in any event ultimately arrives in the channel formed by the reeds.

SUMMARY OF THE INVENTION

The object of this invention is to create auxiliary nozzles for an air-jet loom which assure, on one hand, high directional stability of the air jet stream even at different supply air pressures, while on the other hand generating as large as possible an airflow, and which can be manufactured in a very simple, economical manner.

This problem is solved in that the blow apertures of auxiliary nozzles in accordance with this invention each asasume the shape of a slot extending essentially transversly accross the tubule axis and having a width not exceeding 0.8 mm, with the lateral walls of the slots being contoured in such a way that a minimum cross-section is bounded at least on one side of the slot by an edge of a thickness not exceeding 0.2 mm.

The invention is based on the insight that a physical phenomenon which can be termed "critical cross-section" is determinant of the blow direction of the air jet stream exiting the slot, because super-critical conditions will always be present due to the typical high supply of upsteam pressure of 2 to 7 bars of the auxiliary jet supply air. This phenomenon takes place where the expansion of the air flowing in the auxiliary nozzle begins. The direction of expulsion of the produced air jet does not depend on the direction of the aperture axis, but rather on the location of the plane including this "critical cross-section". An explosive expansion of air takes place at the critical cross-section. In the known designs, the location of the plane of the critical cross-section does not necessarily coincide with the location of the blow aperture, or only in exceptional cases, and moreover is characterized in that its location can vary with variation in the supply or upstream air pressure. Depending on the magnitude of the supply pressure, the location of the plane of the critical cross-section may shift within the blow aperture and its angular orientation relative to the axial direction of the blow aperture also may change. The critical cross-section location may even shift to within the tubules. The lower the supply pressure, the greater the shift of the location of the critical cross-section towards within the blow-aperture and even into the tubules. This is the case to an extreme using a round, relatively large single aperture (German Auslegeschrift No. 21 19 238), as well as holes mounted as sieves (German Patent No. 25 22 335) and for star-shaped single holes. This invention achieves the result that the location of the critical cross-section in all cases remains within the blow-aperture area and in particular at a defined location within the blow aperture. Accordingly, the blow direction of the expelled jet of pressurized air is constant throughout very large ranges of supply pressures. When the critical cross-section is located in the essentially plane lateral surface of the design of the nozzle according to this invention, even with the slot cross-section asymmetrical relative to the essentially plane lateral surface, the blow direction will be perpendicular to this lateral surface. Moreover, the invention offers the advantage that the expelled jet already comprises an enlarged surface at the exit of the blow aperture, where it comes into contact with the surrounding air, and therefore a correspondingly large amount of secondary air will be entrained and a large-volume jet will be formed. Another advantage is obtained in that much less effort is required to manufacture such a slotted aperture than would be the case for instance in making a plurality of small, sieve-forming holes.

Further features and advantages of the invention are discussed in more detail below in relation to the illustrative embodiments and ensuing claims.

BRIEF DESCRIPTION OF THE DRAWINGS

FIG. 9 is an elevation of an auxiliary nozzle shown about 20 times natural size and viewed in the direction opposite the direction of air expulsion; and FIG. 10 is a sideview of the auxiliary nozzle of FIG. 2.

DETAILDED DESCRIPTION OF PREFERRED EMBODIMENTS

Figure 1:
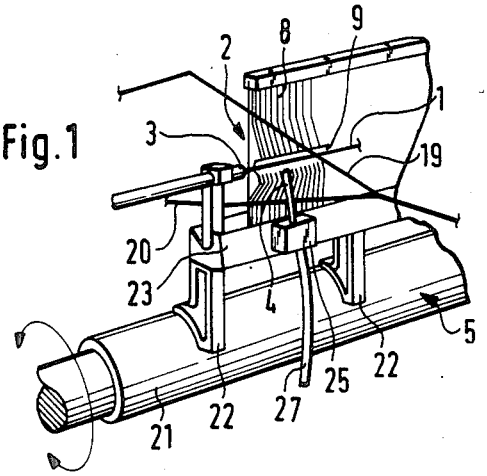
FIG. 1 is a perspective view of the weft insertion area of an air jet loom utilizing the invention.

The partial or detail view shown in perspective in FIG. 1 shows a batten 5 of an air-jet loom mounted on a shaft 21 which is driven in oscillating motion by an actuator (not shown) in the direction of the double arrow. A reed carrier channel 23 extends parallel with shaft 21 and is mounted by supports 22 on the shaft 21. This channel 23 holds the reed blades 8 which guide, between them, the warp yarns 19 and 20. Only two warp yarns 19, 20 are shown for the sake of clarity. In practive, one warp yarn, 19 or 20, passes between each of the reed blades 8. By means of a shed former (not shown) the warp yarns are deflected upwardly and/or downwardly thereby forming each time a shed 2 in a conventional manner. A filling or weft yarn 1 then is inserted into this shed 2 and subsequently is beaten up by the reed blades 8 moving toward a temple means at the cloth fell. Thereupon, the shed position is changed by moving the warp yarns 19, 20 into the opposite location, thereby forming a new shed 2 into which the next weft yarn 1 will be inserted.

The insertion of the weft yarns 1 is implemented by a main air blowing nozzle 3 connected to a source of compressed air (not shown) and mounted by a fasterner to the carrier channel 23, whereby the main air blowing nozzle 3 moves jointly with the batten 5. Together with certain projections, the reed blades 8 form essentially a U-shaped channel 9 for guiding weft yarn 1 to the opposite fabric edge.

To assure the advance of the weft yarn 1 in the channel 9, auxiliary nozzles 4 are arranged to generate an air flow in this channel. These nozzles 4 are mounted equidistantly across the shed in the direction of motion of the weft yarn 1 and are supplied with compressed air in groups. The nozzles 4 are shaped like straight tubules and are mounted to the carrier channel 23, which remains outside the formed shed 2, and enter the shed at the ends of the nozzles 4. Supports 25 are mounted to the carrier channel 23 and support the nozzles 4 which are supplied with compressed air from a compressed-air line 27 in groups via a valve means (not shown). The nozzles 4 produce an air flow which fills the channel 9 as completely and as uniformly as possible. Accordingly, the individual nozzles are intended to expel an air jet which, on one hand, assumes a comparatively large volume and, on the other, is aimed as accurately as possible. The air flow intensity in the channel 9 required for problem-free conveyance of the weft yarn 1 depends on the material involved. Illustratively, when working with a course cotton yarn, the air flow can be substantially weaker than for a smooth filament yarn. It is necessry, therefore, that the air flows expelled from the individual nozzles 4 be adjusted in intensity. In spite of this flow variability, however, the blow direction must remain at least approximately constant.

The design of the nozzles 4 also must take into account volume constraints. The nozzles 4, which move jointly with the batten 5, upon beat-up of the inserted filling yarn 1 will leave the shed 2 and upon the return motion of the batten 5 will re-enter the (changed) shed 2. Accordingly the nozzles 4 must occupy ( especially transversely to the warp yarns 19, 20) only a small cross-section size. Therefore the nozzles 4 are made of relatively thin tubules having a comparatively small wall thickness of about 0.5 mm. It is impossible, therefore, to design the shape of the blow apertures of the nozzles 4 conventionally as aerodynamically optimized discharge nozzles. Additionally, the nozzles 4 must each have a surface that is as flat as possible on the outside to prevent the warp yarns 19, 20 from catching and being damaged.

To keep the beat-up of the inserted weft yarns 1 unhampered, the staggered nozzles 4 are mounted in an offset manner towards the beat-up direction in front of the reed blades and downwardly so that the air jets are blown obliquely upwardly from below into the channel 9. The nozzles 4 also are aligned in such a manner that the expelled air jets point at an approximate angle of 10° in the direction of advancement of the weft yarn 1 through the shed.

An air pressure of 2 to 7 bars is applied to the nozzles 4 to achieve an adequate flow of conveying air in the channel 9, whereby, in conjunction with the various possible sizes of the blow apertures, supercritical conditions will be present in the nozzles. The expelled air jets therefore expand virtually explosively downstream of the critical cross-section, resulting in the phenomenon that the blow direction depends on the location of the plane including the critical cross-section. In order to ascertain precisely the location of the critical cross-section in the tubule and the plane of this cross section, and thereby also to accurately determine the blow direction when the supply air pressure varies, the invention provides that the critical cross-section shall be located within the blow aperture at a specific site. To that end, the blow aperture in accordance with the invention is configured as a slot 7 which extends lengthwise essentally transversely of the longitudinal axis of the nozzle 4 which is in the shape of a tubule 10. The tubule 10 (FIGS. 2 through 10) comprises, at least in the vicinity of the longitudinal slot 7, an elongated or flat oval cross-section of which the largest dimension extends parallel to the direction of the warp yarns. The tubule 10 tapers into a blade-like edge near its free end; however, the edge, rather than being sharp, is rounded as illustrated. The area of the nozzle containing slot 7 comprises an essentially plane surface 6. This plane surface 6 is perpendicular to the blow direction, which extends at an angle of about 10° to the conveying direction of the weft yarns 1. The slot 7 is no wider (i.e. across its smaller demension) than 0.8 mm. Furthermore, the narrowest cross-section dimension of the slot 7 which forms the critical cross-section shall be at a specific location, whereby the blow direction cannot change on account of a pressure-dependent shift of the critical cross-section within the blow aperture.

Figure 5:
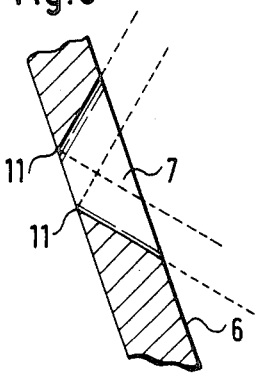
FIG. 5 is a section, shown on an enlarged scale again, of an auxiliary nozzle in the vicinity of the slotted blow aperture with an inside wall critical cross-section.

The embodiment of FIG. 5 shows slot 7 bounded by side walls diverging from the inside out. An inner, sharp edge 11 is formed thereby, defining the critical cross-section where the expansion begins. The blow direction of the expelled jet therefore is perpendicular to the plane (i.e. the plane including the critical cross-section) between the two inner edges 11 bounding the slot 7. Such a slot can be made illustratively by spark erosion, by carrying out a double erosion using a strip-shaped electrode having a thickness coresponding to the slot width and a width (length) corresponding to the slot length, this electrode each time being positioned at another angle to the plane surface 6 of the staggered nozzle 4. This kind of positioning is indicated by the dotted lines in FIG. 5.

Figure 6:
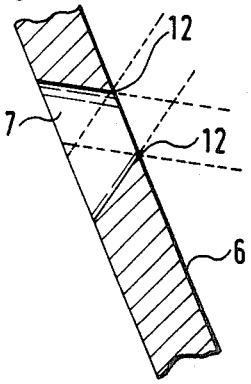
FIG. 6 is a section similar to that of FIG. 5 with a blow aperture having a critical cross-section at the outer wall.

In accordance with the embodiment of FIG. 6, the narrowest cross-section, and hence the critical cross-section of the slot 7 is located at the outer side of the nozzle 4, that is, in the plane surface 6. To that end, the side walls converge in the direction of flow. Again this slotted shape can be machined by spark erosion using a strip-shaped electrode again being positioned at two different angles twice relative to the slot 7 and thereby creating the shape shown in FIG. 6. In this embodiment, the critical cross-section is bounded by two sharp edges 12 extending along the longitudinal direction of the slot 7.

Figure 7:
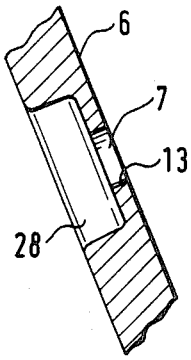
FIG. 7 is a section of an embodiment of an auxiliary nozzle in the vicinity of the blow aperture where the critical cross-section is shifted by a reduction in wall thickness towards the nozzle outer side.
Figure 8:
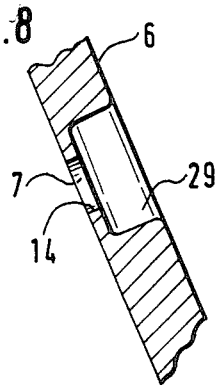
FIG. 8 is a section of an embodiment of an auxiliary nozzle in the vicinity of the blow aperture where the critical cross-section is shifted toward the nozzle inner wall by a clearance or undercut on the outer side toward the inner wall.

In the embodiments of FIGS. 7 and 8, a critical cross-section is precisely defined within the area of the slots 7 by reducing the wall thickness of the nozzle 4 in the vicinity of the slots 7 by means of a clearance or undercut 28, 29 up to one-fifth to one-third of the tubule wall thickness that is, to a maximum of 0.2 mm. As a result, the slot 7 comprises a peripheral thin edge 13, 14 which determines the location of the critical cross-section. The embodiment of FIG. 7 provides that the clearance 28 reducing the wall thickness in the vicinity of the slot 7 be located inside the staggered nozzle 4 on that side which is opposite the plane surface 6. In the embodiment of FIG. 8, the clearance 29, also reducing the wall thickness in this case, is on the side of the plane lateral surface 6.

Moreover, by designing the blow aperture as a slot 7, the expelled air jet already evinces at its beginning a relatively large surface in contact with the surrounding air. A correspondingly large amount of surrounding air is then entrained by that relatively large surface and even where air is expelled in modest quantities, the air jet still shall be of relatively large volume.

Figure 2:
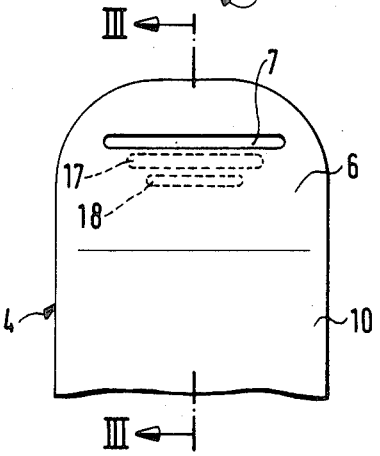
FIG. 2 is an enlarged front view of an auxiliary nozzle as used in the embodiment of FIG. 1, viewed opposite to the air expulsion direction.
Figure 3:
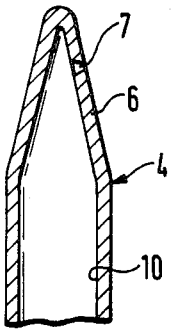
FIG. 3 is a cross-section of the nozzle of FIG. 2 taken along line III—III.

If the total cross-sectional area of a slot 7 should be inadequate to expel enough air, the invention provides that one or two additional apertures be provided which also assume the shapes of slots 17, 18 parallel to the slot 7. The slots 17, 18 correspond in width to the slot 7 and are shaped to match the walls, and further are located at such spacings that the widths remaining between the individual slots 7, 17, 18 are about 0.3 to 1.5 times the width of the slots 7, 17, 18. As indicated in FIG. 2, the slots 17, 18 which are farther away from the closed end of the nozzle 4 progressively decrease in length compared with the length of the slot closest the end.

Figure 4:
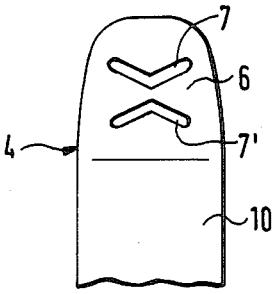
FIG. 4 is a front fiew of another embodiment of an auxiliary nozzle.

An enlargement of the total cross-sectional area is achieved in the embodiment of FIG. 4 in that two chevron shaped slots (7, 7') are provided which are mounted in mirror-symmetrical manner and which each assume the shape of an obtuse angle while converging towards each other at their apices. Because of this non-parallel design, the outer zones of jets expelled through these slots (7, 7'') come into contact with the surrounding air without hampering each other, whereby secondary air can be aspirated without mutual interference.

In the embodiments of FIGS. 9 and 10, a slot 7 is provided in the tubule 10 forming the nozzle 4 in the form of a substantially rectangular contour. The slot 7 is transverse to the axis 33 of the tubule 10 and is bounded toward the tapering free end of the tubule 10 by a lateral wall 30 perpendicular to the essentially plane lateral surface 6. The opposite lateral wall 31 also forms a smooth surface and is oblique by an angle of about 20° to the essentially plane surface 6 in such a manner that the slot cross-section converges from the inside to the outside of the nozzle. The minimum flow cross-section, and hence the critical cross-section, which is bounded by the edge 32 on the side away fro the closed end of the tubule 10, is therefore located at the essentially plane surface 6. The two end walls of the slot 7 are parallel to the longitudinal axis 33 of the tubule and perpendicular to the lateral walls 30, 31. The slot is merely rounded off slightly between the end walls and the lateral walls 30, 31.

In the plane of the essentially flat surface 6 the slot 7 comprises a width between the lateral walls 30, 31—that is, between the lateral wall 30 and the edge 32—of about 0.7 mm. The length of the slot 7 between the two end walls is about triple to four-fold this width.

As is further seen from FIG. 10, the tubule 10 is mirror-symmetric relative to its longitudinal axis, that is, a corresponding and essentially plane lateral surface is located on that side which is opposite the essentially plane lateral surface 6. Together these two plane lateral surfaces subtend an angle of about 20° and thereby an angle of about 10° to the apex 33 of the tubule 10. The distance between the center of the slot 7 and the free end of the tubule is somewhat more than triple the slot width between the lateral wall 30 and the edge 32.

The slot 7 is asymmetric relative to the essentially plane surface 6 and illustratively can be machined using spark erosion and a strip-shaped electrode. The length of the strip-shaped electrode corresponds to the slot length and its width is somewhat less than that of the slot 7. This electrode on one hand is made perpendicular to the essentially plane lateral surface 6 of the tubule 10, whereby the lateral wall 30 and the areas of the end walls adjacent to it are produced. Thereupon the electrode is made to move through an angle of 20° toward the essentially plane lateral surface and, where called for, is shifted by an amount corresponding to the slot width and applied to the tubule.

It was found that in spite of the shape of the slot 7 which is asymmetric relative to the essentially plane lateral surface 6, a blown air jet is produced which points perpendicularly to the essentially plane surface 6 and which further is highly directionally stable even at different supply pressures.

In order to further improve the directional stability of the expelled air jet transversely to the lateral walls 30, 31, a recess 35 is provided in the embodiment of FIGS. 9 and 10 in the back wall of the tubule 10 opposite the slot 7. The recess 35 assumes the shape of a sloping flat-sided groove about 0.05 to 0.2 mm deep. The apex of the recess is parallel to the slot 7. The length of the recess corresponds to about the length of the slot. The flanks of the trough-like recess subtend flat angles with the inside wall. Such a recess can be simply obtained, for instance, by introducing a corresponding tool into the slot 7, whereby the back wall will be correspondingly forced outwardly. The bumpy elevation so produced on the outside of the back wall 10 can be ground off thereafter.

It will be understood that other variations of the invention can be made by those skilled in the art that may appear to be different from the illustrated and described embodiments, which must be viewed as illustrative and exemplary rather than as limiting the scope of the invention which is defined in the claims below.

We claims:

1. In an auxiliary nozzle for an air-jet loom, wherein the nozzle is arranged to be mounted on the loom batten for movement therewith into and out of the sheds formed by the loom, and is configured as a tubule closed and tapered blade-like at its free end so as to present at least one plane lateral surface through which at least one blow aperture extends for expelling a weft conveying jet of air in the direction of weft conveyance, the improvement wherein the blow aperture is in the shape of a slot having a length essentially extending transversely of the longitudinal tubule axis and having a width not exceeding 0.8 mm, said aperture including sidewalls contoured such that the minimum cross-section is bounded on at least one side of the slot by an edge having a thickness not exceeding 0.2 mm.

2. The improvement in an auxiliary nozzle as claimed in claim 1, wherein the slot is located in a recessed portion of the tubule wall terminating at said plane lateral surface.

3. The improvement in an auxiliary nozzle as claimed in claim 1, wherein the slot is bounded by upper and lower side walls extending oblique to the plane lateral surface.

4. The improvement in an auxiliary nozzle as claimed in claim 1, including a pair of blow apertures in the shape of said slot, each blow aperture extending lengthwise diagonally away from a central apex in a chevron form with the apices of the slots disposed opposite each other and with one slot inverted relative to the other.

5. The improvement in an auxiliary nozzle as claimed in claim 4, wherein the minimum spacing between slots corresponds essentially to a slot width.

6. The improvement in an auxiliary nozzle as claimed in claim 1, including a plurality of blow apertures in the shape of said slot, all the slot apertures extending parallel to each other.

7. The improvement in an auxiliary nozzle as claimed in claim 6, wherein the spacing between slots corresponds essentially to a slot width.

8. The improvement in an auxiliary nozzle as claimed in claim 6, werein the slots progressively decrease in length from the closed end of the tubule towards the opposite end of the tubule.

9. The improvement in an auxiliary nozzle as claimed in claim 1, wherein the tubules are flat-oval in cross section in the area of the plane lateral surface, with the longer dimension extending in the lengthwise direction of the blow aperture slot and essentially parallel to the direction of warp threads forming the shed of the loom with which the nozzle is intended for use.

10. The improvement in an auxiliary nozzle as claimed in claim 1, wherein the slot is defined by an upper wall disposed towards the closed end of the tubule and an opposite lower wall, wherein the upper wall extends substantially normal to said plane lateral surface and said lower wall comprises said edge having at thickness not exceeding 0.2 mm.

11. The improvement is an auxiliary nozzle as claimed in claim 10 wherein said lower wall also comprises a surface extending away from said thin edge at an oblique angle relative to said upper wall so that the blow aperture slot converges towards the outside of the tubule.

12. The improvement in an auxiliary nozzle as claimed in claim 11, wherein said lower wall surface is inclined at an angle of about 20° to the plane lateral surface.

13. The improvement in an auxiliary nozzle as claimed in claim 1, where in the center of said slot is disposed at a distance from the free end of the tubule corresponding to about three times the width of the slot.

14. The improvement in an auxiliary nozzle as claimed in claim 1, wherein the length of the slot is about 3–4 times its width.

15. The improvement in an auxiliary nozzle as claimed in claim 1, said slot including end walls extending substantially normal to the lengthwise extending lateral walls of the slot.

16. The improvement in an auxiliary nozzle as claimed in claim 1, wherein said plane lateral surface subtends an angle of approximately 10° with the longitudinal axis of the tubule.

17. The improvement in an auxiliary nozzle as claimed in claim 1, wherein an interior wall area of the tubule opposite the blow aperature is recessed away from the blow aperature along a direction parallel to the blow aperture slot.

* * * * *